US006517392B2

(12) United States Patent
Murakami et al.

(10) Patent No.: US 6,517,392 B2
(45) Date of Patent: Feb. 11, 2003

(54) CRIMP CONNECTOR

(75) Inventors: Takao Murakami, Shizuoka (JP); Yoshitsugu Sawada, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/777,862

(22) Filed: Feb. 7, 2001

(65) Prior Publication Data

US 2001/0014562 A1 Aug. 16, 2001

(30) Foreign Application Priority Data

Feb. 15, 2000 (JP) ..... 2000-036101

(51) Int. Cl.[7] ..... H01R 4/10
(52) U.S. Cl. ..... 439/877
(58) Field of Search ..... 439/877, 878, 439/879, 880, 881, 882

(56) References Cited

U.S. PATENT DOCUMENTS 3,077,027 A * 2/1963 Sola et al.
5,664,967 A * 9/1997 Hatagishi et al. ..... 439/596
6,244,901 B1 * 6/2001 Fujii et al. ..... 439/596

* cited by examiner

*Primary Examiner*—Gary Paumen
*Assistant Examiner*—James R. Harvey
(74) *Attorney, Agent, or Firm*—Armstrong, Westerman & Hattori, LLP

(57) ABSTRACT

A crimp connector 1 comprises a plurality of crimp terminals 23, and a housing 22 for containing the crimp terminals 23. Each of the crimp terminals 23 includes an electric wire crimping portion 31 and electric wire fixing portions 32, 32. The housing 22 includes partition walls 26, 26 uprightly provided on a base plate 25 to define groove-shaped terminal receiving chambers 24. The partition walls 26, 26 are provided with concave cut-out spaces 28, 28. The cut-out spaces 28, 28 are formed at positions facing with outer faces of the electric wire fixing portions 32, 32.

9 Claims, 4 Drawing Sheets

CRIMP CONNECTOR

BACKGROUND OF THE INVENTION

1. Field of the Invention

The present invention relates to a crimp connector comprising a plurality of crimp terminals and a housing for containing the crimp terminals.

2. Description of the Related Art

Heretofore, various types of crimp connectors for crimping and connecting covered wires have been known.

In FIG. 7, a conventional crimp connector 1 consists of a housing 3 in which a plurality of terminal receiving chambers 2 are arranged in parallel, and a plurality of crimp terminals 4 are respectively contained in the terminal receiving chambers 2.

The terminal receiving chamber 2 is defined by a pair of partition walls 6, 6 which are uprightly provided on a base plate 5. A distance between the partition walls 6, 6 is so designed as to be almost equal to a width of the crimp terminal 4. A height of the partition wall 6 is so designed as to be lower than a height of the crimp terminal 4.

The crimp terminal 4 is contained in the terminal receiving chamber 2 with its electric wire guide-out end 8 positioned a slightly inside of a back end 7 of the housing 3. Moreover, the crimp terminal 4 includes a box-like electrical contact portion provided at a forward end part of the housing 3. In the rear of the electrical contact portion, is continuously provided a wire crimping portion 10 for crimping a covered electric wire 9.

The wire crimping portion 10 is provided with a pair of crimping pieces 11, 11 respectively having crimping slits for crimping the covered electric wire 9. In an area between the wire crimping portion 10 and the electric wire guide-out end 8, are formed a pair of electric wire fixing pieces 12, 12 which project in a tongue-like shape. By caulking the wire fixing pieces 12, 12 with a caulking punch 13 (see FIG. 8), the covered electric wire 9 is fixed.

In FIG. 8, the caulking punch 13 is provided at its lower end with a concave caulking portion 14 having a curved face so that a pair of the wire fixing portions 12, 12 are caulked inwardly along the curved face. The caulking portion 14 is formed wider than the crimp terminal 4. A depth d of the caulking portion 14 is formed relatively small, because the lower end of the caulking punch 13 is brought near upper end faces 15, 15 of the partition walls 6, 6 when the caulking punch 13 is moved in a direction of an arrow R to caulk the wire fixing portions 12, 12.

However, the above described prior art has had a problem that the wire fixing portions 12, 12 cannot be sufficiently caulked due to the shallow depth d of the caulking portion 14 of the caulking punch 13. For this reason, caulking condition of the wire fixing portions 12, 12 is not stabilized and there occur variations in their holding forces with respect to the covered wire 9.

Further, the wire fixing portions 12, 12 which have been caulked with the caulking punch 13 protrude upward above the upper end faces 15, 15 of the partition walls 6, 6 due to a shape of the caulking portion 14, and accordingly, a between-terminal leak is likely to occur between the wire fixing portions 12, 12 of the adjacent crimp terminals 4 interposing the partition wall 6.

The present invention has been made in view of the above described circumstances, and it is an object of the invention to provide a crimp connector in which the between-terminal leak can be prevented and the holding force for the covered wire will be stabilized.

SUMMARY OF THE INVENTION

A crimp connector according to the present invention comprises a plurality of crimp terminals, and a housing for containing the crimp terminals, each of the crimp terminals including an electric wire crimping portion adapted to crimp a covered electric wire, and electric wire fixing portions positioned closer to an electric wire guide-out end than the electric wire crimping portion and adapted to caulk the covered electric wire, the housing including partition walls uprightly provided on a base plate to define groove-shaped terminal receiving chambers for receiving the crimp terminals, the terminal receiving chambers being arranged in parallel in a row in a number at least equal to the number of the crimp terminals, wherein the partition walls are provided with concave cut-out or recessed spaces for receiving a caulking punch at positions facing with outer faces of the electric wire fixing portions.

According to another aspect of the present invention, the electric wire fixing portion is provided at only one side of the crimp terminal.

According to a further aspect of the present invention, the recessed spaces are provided on respective intermediate portions of the partition walls in a longitudinal direction.

According to a still further aspect of the present invention, the recessed spaces have end surfaces of the partition walls which extend from the base plate to the upper end face.

According to a still further aspect of the present invention, a height of the partition walls is at least higher than a height of the crimp terminals in a state after the electric wire fixing portions have been caulked.

According to the feature of the present invention, there is provided the crimp connector wherein the partition walls is provided the crimp connector wherein the partition walls defining the terminal receiving chambers in the housing are formed with the concave or recess cut-out spaces. Because the concave cut-out spaces are formed at the positions facing with the outer faces of the electric wire fixing portions, the caulking punch can be inserted deep below the upper end faces of the partition walls when the electric wire fixing portions are caulked. By thus inserting the caulking punch deep through the cut-out spaces, the electric wire fixing portions can be fully caulked. The holding force with respect to the covered electric wire will be stabilized and enhanced.

Since the cut-out spaces are concave with respect to the partition wall, the cut-out spaces of the adjacent terminal receiving chambers are not communicated with each other. Therefore, the between-terminal leak will not occur through the cut-out spaces.

According to a second aspect of the invention, one cut-out space is formed in the terminal receiving chamber. Accordingly, a thickness of the partition wall can be smaller than in the connector provided with a pair of the electric wire fixing portions on both sides of the crimp terminal. This enables a pitch of the crimp terminals contained in the terminal receiving chambers to be reduced.

According to a third aspect of the invention, the cut-out spaces are never formed in continuity with ends of the housing. Therefore, strength of the partition walls at the ends of the housing can be maintained.

According to a fourth aspect of the invention, the distal end of the caulking punch can be inserted deeply until it is brought near the base plate.

According to a fifth aspect of the invention, since the partition walls are higher than in the prior art, the between-terminal leak between the crimp terminals in the adjacent terminal receiving chambers can be reliably prevented.

DESCRIPTION OF THE PREFERRED EMBODIMENTS

Figure 1:
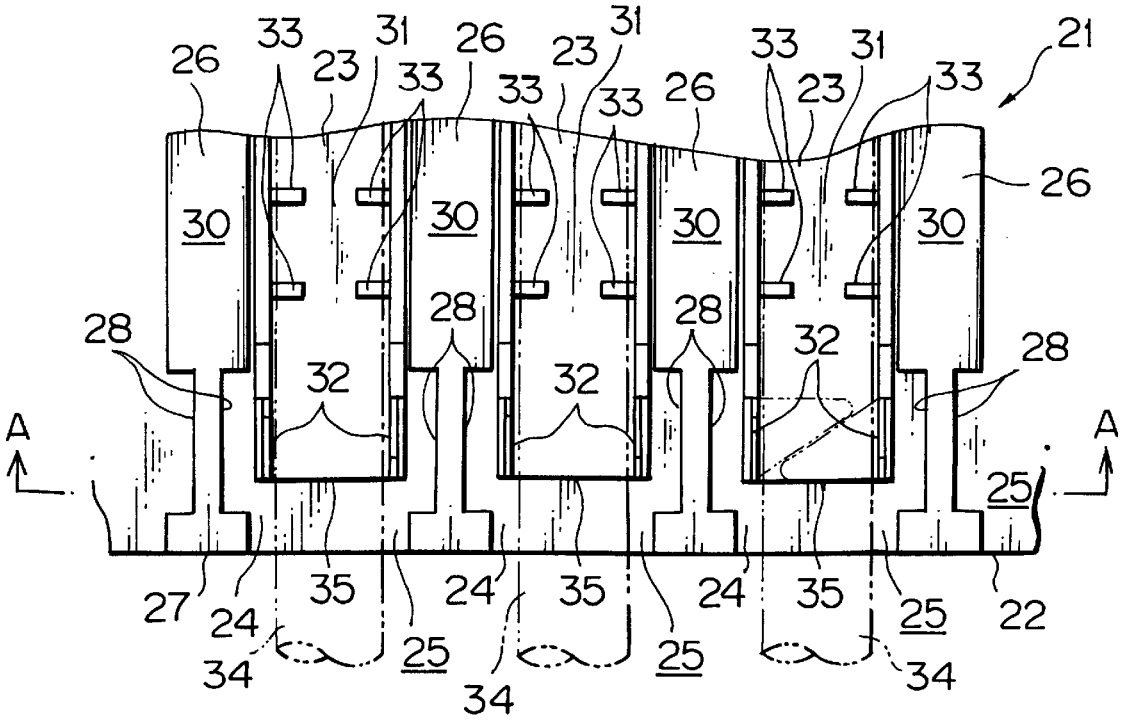
FIG. 1 is a plan view of an essential part of a crimp connector according to one embodiment of the invention.

Referring now to the drawings, one embodiment of the present invention will be described in detail.

Figure 2:
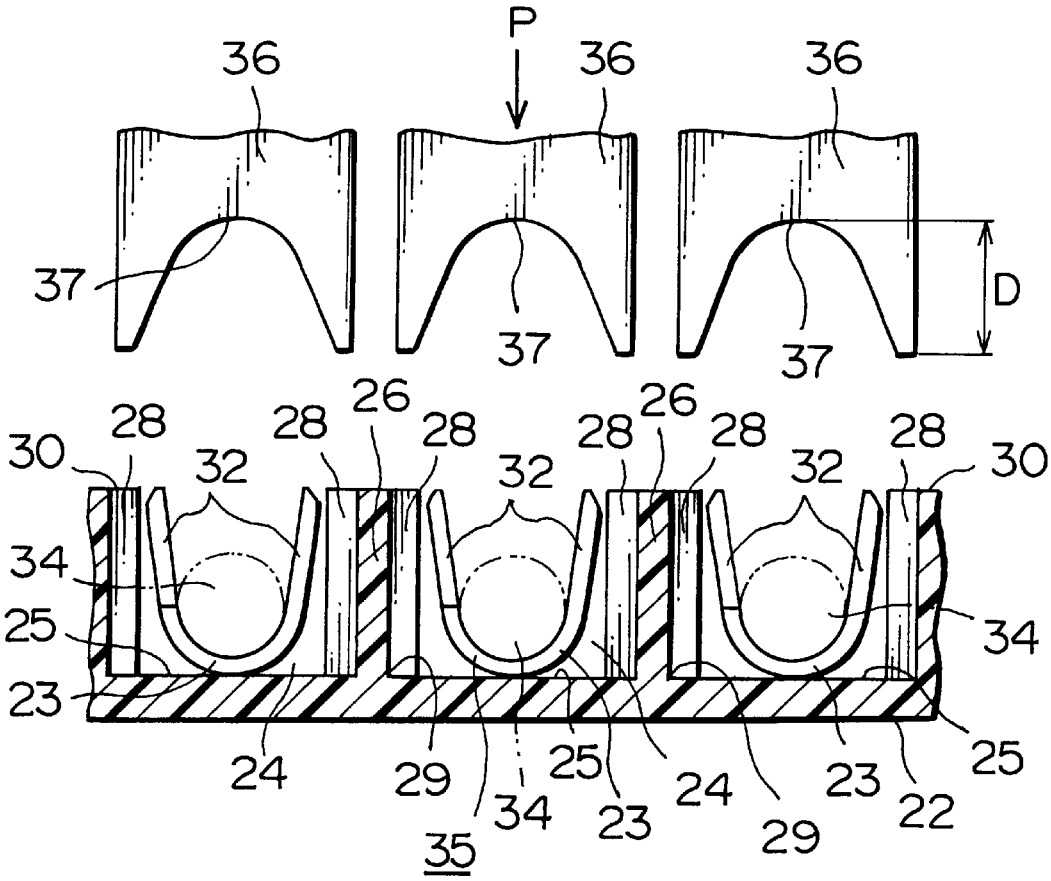
FIG. 2 is a sectional view taken along a line A—A of FIG. 1.

FIG. 1 is a plan view of an essential part of a crimp connector according to the embodiment of the invention, and FIG. 2 is a sectional view taken along a line A—A of FIG. 1.

Figure 7:
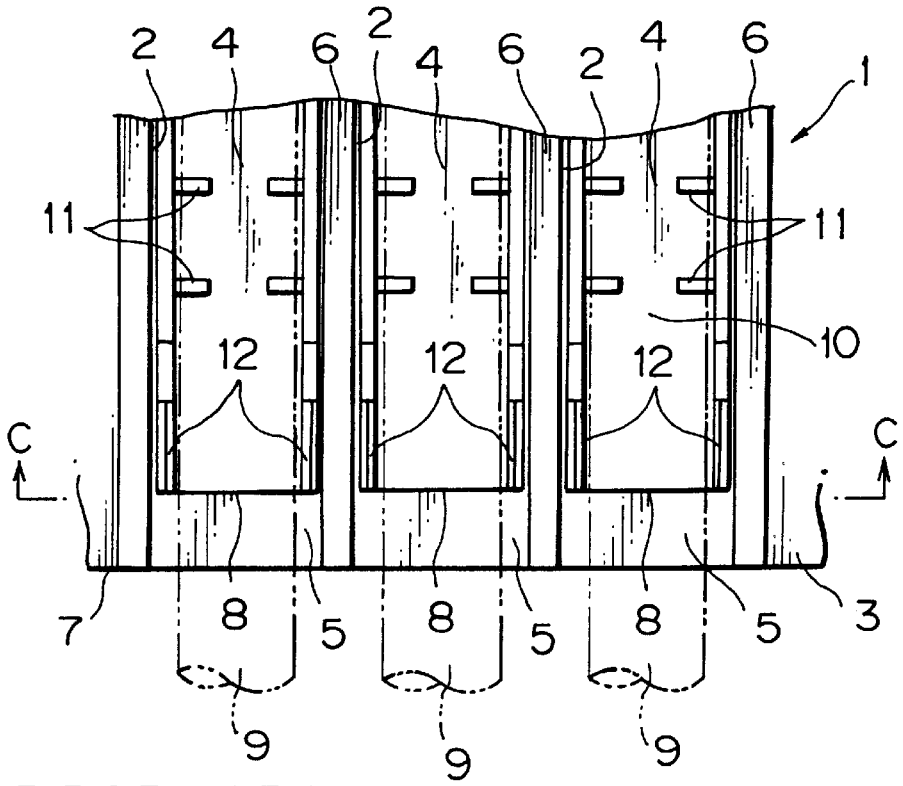
PRIOR ART FIG. 7
FIG. 7 is a plan view of an essential part of a crimp connector in a conventional example.

In FIGS. 1 and 2, a crimp connector 21 consists of a housing 22 and a plurality of crimp terminals 23 in a same manner as the crimp connector 1 described in the conventional example (see FIG. 7).

The housing 22 is made of synthetic resin and has terminal receiving chambers 24 which are arranged in parallel in a lateral row in a number at least equal to the number of the crimp terminals 23 in this embodiment. Each of the terminal receiving chambers 24 is defined by a pair of partition walls 26, 26 which are uprightly provided on a flat base plate 25. The terminal receiving chamber 24 is in a form of a groove extending straight from a front end (not shown) to a back end 27 of the housing 22 to receive the crimp terminal 23.

Figure 3:
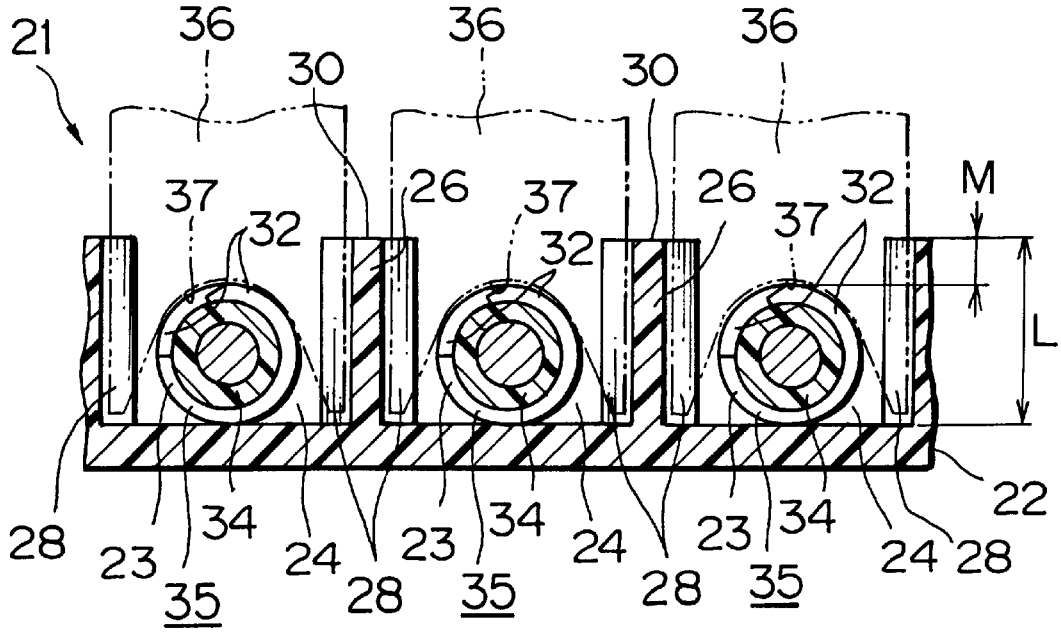
FIG. 3 is a sectional view taken at a same position as FIG. 2 showing a state in which wire fixing portions have been caulked.

The partition wall 26 separates the adjacent terminal receiving chambers 24 from each other. A distance between the partition walls 26, 26 substantially corresponds to a width of the crimp terminal 23. A height L of the partition wall 26 (see FIG. 3) is at least higher than a height of the crimp terminal 23 after below mentioned wire fixing portions 32, 32 have been caulked. The height L of the partition wall 26 (see FIG. 3) in this embodiment is approximately the same as a height of the below mentioned wire fixing portions 32, 32 in a projected state before they have been caulked (see FIG. 2).

The partition wall 26 is formed with a pair of concave cut-outs or recesses 28, 28 in a shape of a concave space at an intermediate part of the wall in a longitudinal direction which is an extending direction of the terminal receiving chambers 24. The cut-out spaces 28, 28 are formed at positions facing with outer faces of the below mentioned wire fixing portions 32, 32. The cut-out spaces 28, 28 extend straight from a base end 29 to an upper end 30 of the partition wall 26. The base end 29 is continued to the base plate 25. A length of the cut-out spaces 28, 28 in a longitudinal direction is sufficiently larger than a length of the below mentioned wire fixing portions 32, 32 and in such a size that a below mentioned caulking punch 36 can be smoothly inserted.

The adjacent terminal receiving chambers 24, 24 are separated by a thin walled portion of the partition wall 26 because of a concave profile of the cut-out spaces 28. In the present embodiment, the adjacent terminal receiving chambers 24, 24 are made water-tight with respect to each other.

The aforesaid crimp terminal 23 is manufactured by stamping a metal plate having electric conductivity, and composed of a box-like electrical contact portion (not shown), an electric wire crimping portion 31 continued therefrom, and a pair of the electric wire fixing portions 32, 32 further continued therefrom.

The electric wire crimping portion 31 is provided with a pair of crimping pieces 33, 33 each having a crimping slit. The crimping pieces 33, 33 each having a crimping slit. The crimping pieces 33, 33 each having a crimping slit. The crimping pieces 33, 33 are adapted to crimp the covered wire 34. The electric wire fixing portions 32, 32 are projected in a tongue-like shape and adapted to be caulked with the caulking punch 36 to fix the covered wire 34. An electric wire guide-out end 35, which is a back end of the crimp terminal 23, is continuously formed in the rear of the electric wire fixing portions 32, 32.

In other words, the crimp terminal 23 has the electrical contact portion (not shown) at its forward end and the electric wire fixing portions 32, 32 at the electric wire guide-out end 35 at its backward end. The electric wire fixing portions 32, 32 project upward before they are caulked in a direction in which the partition walls 26, 26 are uprightly provided. A height of the electric wire fixing portions 32, 32 before they are caulked is substantially the same as the height of the partition walls 26, 26, but not limited to the same height.

In the above described structure, the crimp connector 21 is assembled in the following steps.

As a first step, the crimp terminals 23 are respectively received in the terminal receiving chambers 24 in the housing 22 and fixed at determined positions. On this occasion, each of the crimp terminals 23 is received with the outer faces of its electric wire fixing portions 32, 32 faced with the cut-out or recessed spaces 28, 28 of the partition walls 26, 26. The electric wire guide-out end 35 of the crimp terminal 23 is positioned slightly inward from the back end 27 of the housing 22. The crimp terminal 23 is fixed by appropriate fixing means which have been conventionally employed.

After all the crimp terminals 23 have been received and fixed, a step of crimping the covered wires 34 to the crimp terminals 23 is conducted. The covered wires 34 are crimped and connected with the crimping pieces 33, 33 of the electric wire crimping portion 31.

Then, a step of fixing the covered wires 34 is conducted. As shown in FIG. 2, the caulking punch 36 is moved in a direction of an arrow P, and caulks the electric wire fixing portions 32, 32 as they fall inwardly to fix the covered wire 34 (see FIG. 3). The electric wire fixing portions 32, 32 are guided by the caulking portion 37 of the caulking punch 36 having the curved face to fix the covered wire 34 in a winding manner. The caulked portions of the electric wire fixing portions 32, 32 are positioned lower than the upper end faces 30 of the partition walls 26 by a distance M (see FIG. 3) which can be optionally set.

When all the covered wires 34 have been fixed, a series of assembling works have been completed. In some cases, a cover may be fitted to the housing 22 so as to cover the crimped parts, but the description will be omitted here.

Figure 8:
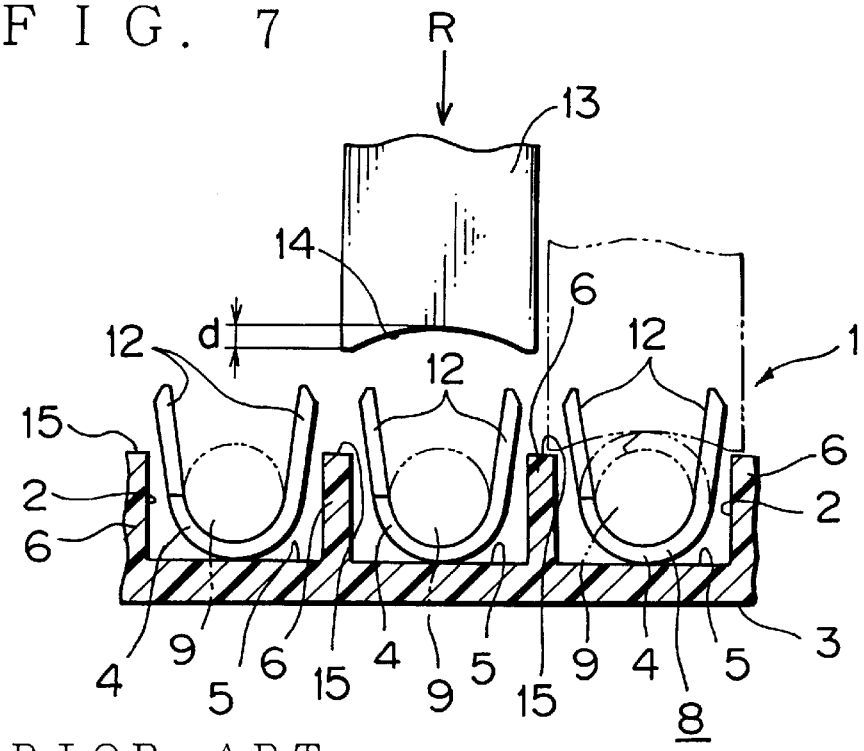
PRIOR ART FIG. 8
FIG. 8 is a sectional view taken along a line C—C of FIG. 7.

Referring further to the caulking punch 36, the caulking punch 36 is made of metal which is sufficiently harder than the crimp terminal 23, and the caulking portion 37 at its lower end is recessed in an inverted U-shape. The caulking punch 36 has such a width that it can be inserted into the cut-out spaces 28, 28 of the partition walls 26, 26. The caulking portion 37 has such a depth D that the distal end of the caulking punch 36 is brought near the base plate 25 when the electric wire fixing portions 32, 32 have fixed the covered wire 34 with sufficient holding forces. For this reason, the caulking portion 37 is formed deeper than the depth d (D>d) of the caulking portion 14 of the caulking punch 13 in the conventional example (see FIG. 8).

As described above referring to FIGS. 1 to 3, the concave cut-out spaces 28, 28 are formed in the partition walls 26, 26 of the terminal receiving chamber 24. Accordingly, when the electric wire fixing portions 32, 32 are caulked, the caulking punch 36 can be inserted deep below the upper end faces 30, 30 of the partition walls 26, 26. The electric wire fixing portions 32, 32 are sufficiently caulked in this manner, and the holding force for the covered wire 34 will be stabilized and enhanced.

Further, because the concave or recessed cut-out spaces 28, 28 are formed in the partition walls 26, 26 preferably at intermediate parts in a longitudinal direction (although they can be formed at the end parts), strength of the partition walls 26, 26 can be maintained at the back end 27 of the housing 22, and performance of the partitions 26, 26 will be fully exerted.

Further, because the cut-out or recess spaces 28, 28 are formed so as to preferably include the base ends 29, 29 which are continued to the base plate 25 of the terminal receiving chamber 24 (although they may be formed at the middle part), the distal end of the caulking punch 36 can be inserted deeply until it is brought near the base plate 25. Needless to say, the holding force for the covered wire 34 will be further stabilized.

Still further, since the partition walls 26, 26 are high, a between-terminal leak between the crimp terminals 23, 23 in the adjacent terminal receiving chambers 24 can be reliably prevented.

Figure 4:
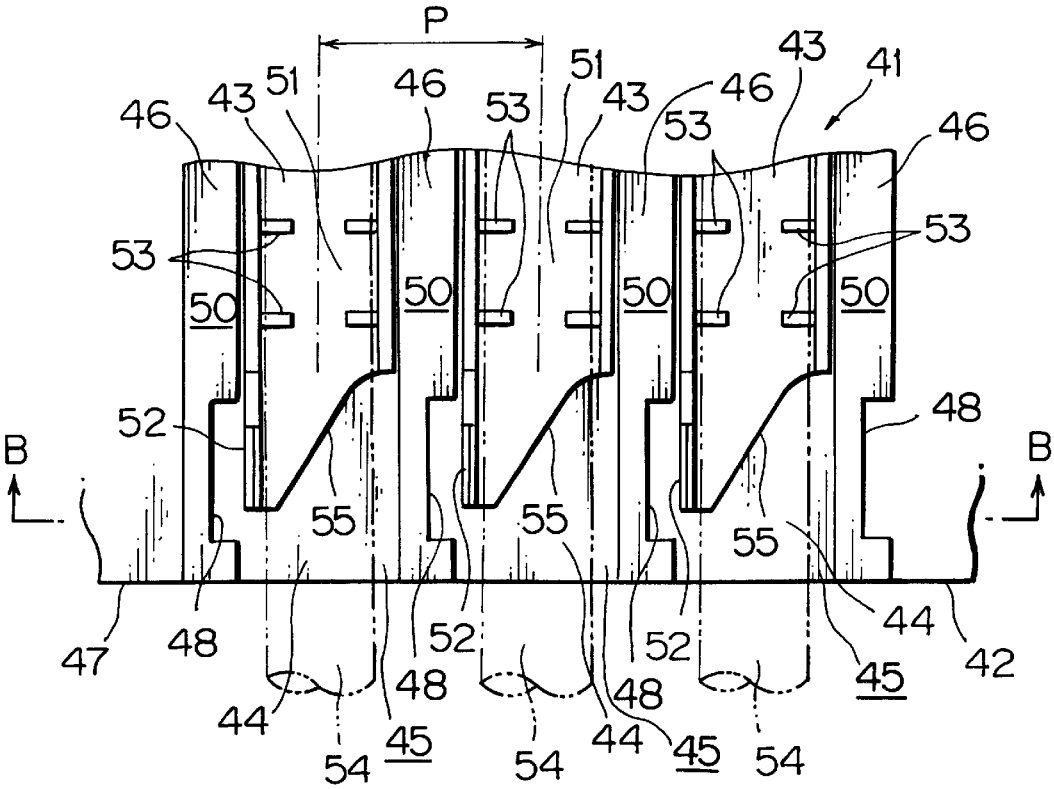
FIG. 4 is a plan view of an essential part of a crimp connector according to another embodiment of the invention.
Figure 5:
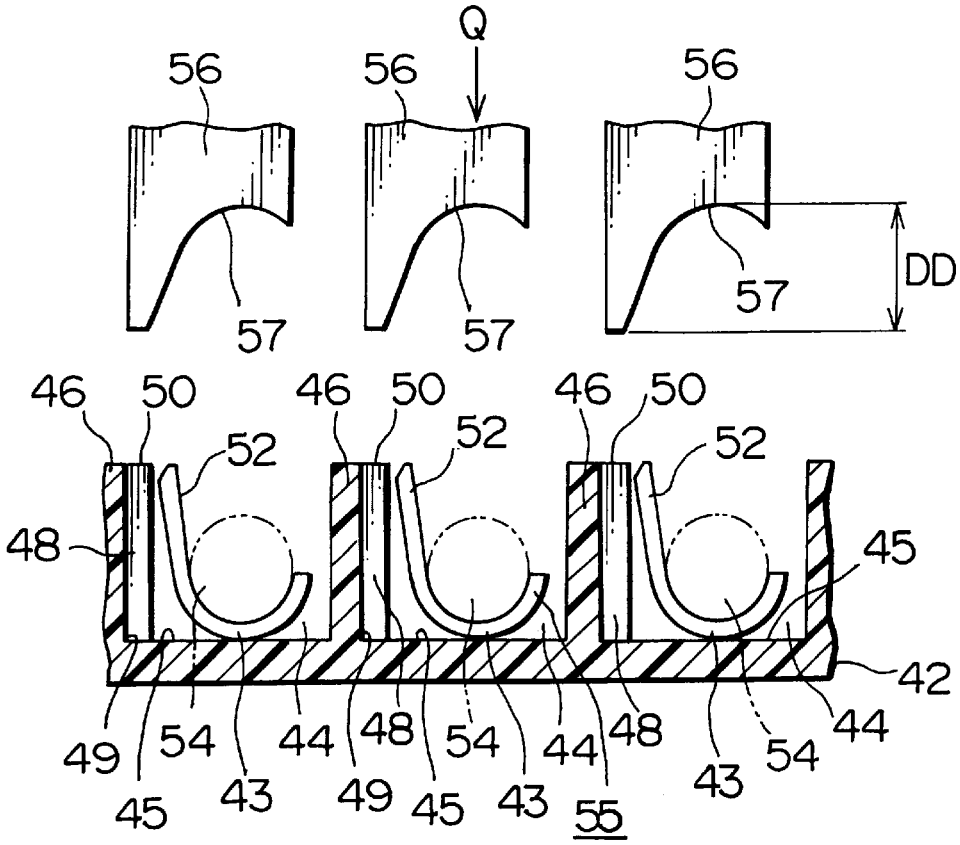
FIG. 5 is a sectional view taken along a line B—B of FIG. 4.
Figure 6:
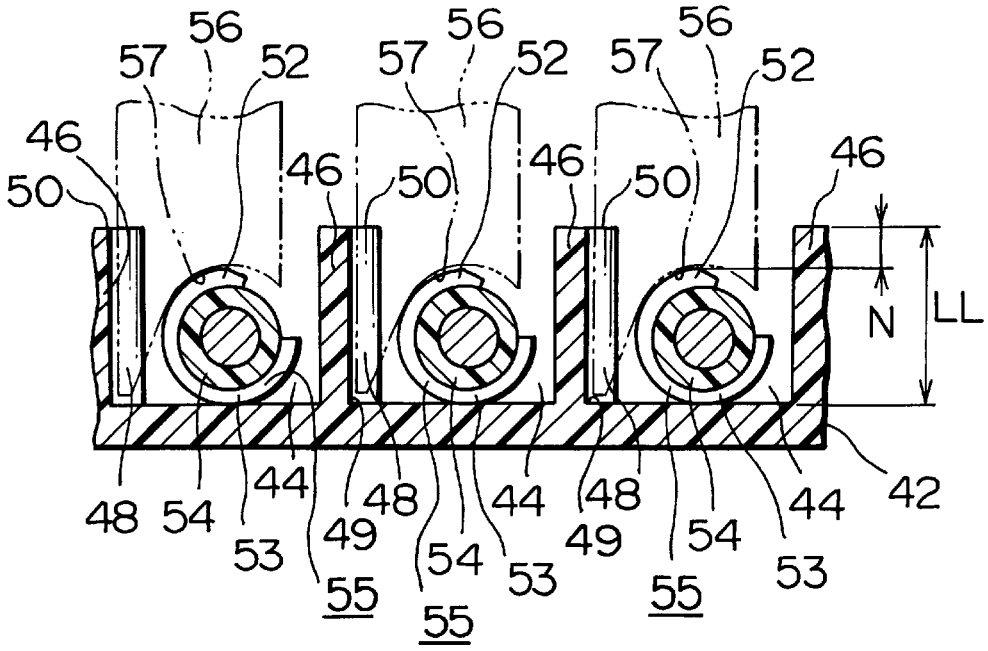
FIG. 6 is a sectional view taken at a same position as FIG. 5 showing a state in which the wire fixing portions have been caulked.

FIG. 4 is a plan view of an essential part of a crimp connector according to another embodiment of the present invention. FIG. 5 is a sectional view taken along a line B—B of FIG. 4, and FIG. 6 is a sectional view taken at a same position as FIG. 5 showing a state in which the wire fixing portions have been caulked.

In FIGS. 4 and 5, the crimp connector 41 is composed of a housing 42 and a plurality of crimp terminals 43.

The housing 42 is made of synthetic resin and has terminal receiving chambers 44 which are arranged in parallel in a lateral raw. Each of the terminal receiving chambers 44 is defined by a pair of partition walls 46, 46 which are uprightly provided on a flat base plate 45. Each of the terminal receiving chambers 44 is in a form of a groove extending straight from a front end (not shown) to a back end 47 of the housing 42. In this embodiment, the adjacent terminal receiving chambers 44 are water-tight from each other.

The partition wall 46 separates the adjacent terminal receiving chambers 44 from each other. A distance between the partition walls 46, 46 substantially corresponds to a width of the crimp terminal 43. A height LL of the partition wall 46 (see FIG. 6) is at least higher than a height of the crimp terminal 43 after a below mentioned wire fixing portion 52 has been caulked. The height LL of the partition wall 46 (see FIG. 6) in this embodiment is approximately the same as a height of the below mentioned wire fixing portion 52 in a projected state before it has been caulked (see FIG. 5).

One of the partition walls 46 is formed with a concave cut-out or recess space 48 at an intermediate part thereof in a longitudinal direction which is an extending direction of the terminal receiving chambers 44. The cut-out space 48 is formed at a position facing with an outer face of the below mentioned wire fixing portion 52. The cut-out space 48 extends straight from a base end 49 to an upper end 50 of the one partition wall 46. The base end 49 is continued to the base plate 45. A width of the cut-out space 48 in a longitudinal direction is sufficiently larger than a width of the below mentioned wire fixing portion 52 and in such a size that a below mentioned caulking punch 56 can be smoothly inserted.

The aforesaid crimp terminal 43 is manufactured by stamping a metal plate having electric conductivity, and composed of a box-like electrical contact portion (not shown), an electric wire crimping portion 51 continued therefrom, and the electric wire fixing portion 52 further continued therefrom. The electric wire fixing portion 52 is formed at only one side of the crimp terminal 43 (at a side of the one partition wall 46). Before the electric wire fixing portion 52 is caulked, the electric wire fixing portion 52 is projected in a tongue-like shape in a direction in which the one partition wall 46 extends. The electric wire crimping portion 51 is provided with a pair of crimping pieces 53, 53 each having a crimping slit. The crimping pieces 53, 53 are adapted to crimp the covered wire 54. Reference numeral 55 represents an electric wire guide-out end which is a backward end of the crimp terminal 43.

In the above described structure, the crimp connector 41 is assembled in the following steps.

As a first step, the crimp terminals 43 are respectively received in the terminal receiving chambers 44 in the housing 42 and fixed at determined positions. On this occasion, each of the crimp terminals 43 is received with the outer face of its electric wire fixing portion 52 faced with the cut-out space 48 of the one partition wall 46. The electric wire guide-out end 55 of the crimp terminal 43 is positioned slightly inward from the back end 47 of the housing 42. The crimp terminal 43 is fixed by appropriate fixing means which have been conventionally employed.

After all the crimp terminals 43 have been received and fixed, a step of crimping the covered wires 54 to the crimp terminals 43 is conducted. The covered wire 54 is crimped and connected with the crimping pieces 53, 53 of the electric wire crimping portion 51.

Then, a step of fixing the covered wire 54 is conducted. As shown in FIG. 5, the caulking punch 56 is moved in a direction of an arrow Q, and caulks the electric wire fixing portion 52, as it falls inwardly to fix the covered wire 54. The electric wire fixing portion 52 is guided by the caulking portion 57 of the caulking punch 56 having the curved face (formed in an inverted J-shape) to fix the covered wire 54 in a winding manner. A depth DD of the caulking portion 57 is equal to the depth D (see FIG. 2) of the aforesaid caulking portion 37. The caulked portion of the electric wire fixing portion 52 is positioned lower than the upper end face 50 of the partition wall 46 by a distance N (see FIG. 6) which can be optionally set. When all the covered wires 54 have been fixed, a series of assembling works have been completed.

The crimp connector 41 described above referring to FIGS. 4 to 6 has similar effects to the aforesaid crimp connector 21 (see FIG. 1). There is a further effect that a size of the crimp connector 41 itself can be minimized. A thickness of the partition wall 46 can be smaller than the aforesaid connector 21. This enables a pitch P (see FIG. 4) of the crimp terminals 43 contained in the terminal receiving chambers 44 to be reduced.

It is also possible to dispose the above described crimp connectors 21 and 41 in an electrical connection boxes which are mounted on a vehicle in a plurality of stacks (A direction of the stack corresponds to the aforesaid arrows P and Q). In this case, the crimp connectors 21 and 41 may be called as plate connectors for the electrical connection boxes, or stacked plate connectors. Alternatively, a plurality of the crimp connectors 21 or 41 can be stacked into a single crimp connector as the stacked plate connector.

Although the present invention has been fully described by way of examples referring to the accompanying drawings, it is apparent that various changes and modifications can be added to the invention within a scope of the present invention.

What is claimed is:

1. A crimp connector comprising;

a plurality of crimp terminals, and a housing for containing said crimp terminals, each of said crimp terminals including an electric wire crimping portion adapted to crimp a covered electric wire, and electric wire fixing portions positioned closer to an electric wire guide-out end than said electric wire crimping portion and adapted to caulk said covered electric wire, said housing including a base plate, and partition walls uprightly extending from said base plate to provide surfaces defining groove-shaped terminal receiving chambers for receiving said crimp terminals, said terminal receiving chambers being arranged in parallel in a row in a number at least equal to the number of said crimp terminals, wherein each said partition wall is provided on its longitudinal surface with a concave recessed space for receiving a caulking punch, said space being disposed at a position facing with an outer face of an electric wire fixing portion.

2. The crimp connector as claimed in claim 1, wherein said electric wire fixing portion is provided at only one side of said crimp terminal.

3. The crimp connector as claimed in claim 1, wherein each said concave recessed space is provided on an intermediate portion of said partition wall spaced inwardly from a longitudinal end thereof.

4. The crimp connectors as claimed in claim 2, wherein each said concave recessed space is provided on an intermediate portion of said partition wall spaced inwardly from longitudinal ends thereof.

5. The crimp connector as claimed in claim 1, wherein each said recessed space is formed within an associated partition wall and has a surface adjacent a longitudinal end of said associated partition wall which extends the full height of said partition wall.

6. The crimp connector as claimed in claim 2, wherein said recessed space is formed within an associated partition wall and has a surface adjacent a longitudinal end of said associated partition wall which extends the full height of said partition wall.

7. The crimp connector as claimed in claim 3, wherein said recessed space is formed within an associated partition wall and has a surface adjacent a longitudinal end of said associated partition wall which extends the full height of said partition wall.

8. The crimp connector as claimed in claim 4, wherein said recessed space is formed within an associated partition wall and has a surface adjacent a longitudinal end of said associated partition wall which extends the full height of said partition wall.

9. The crimp connector as claimed in any one of claims 1 to 8, wherein a height of said partition walls is at least higher than a height of said crimp terminals after said electric wire fixing portions have been caulked.

* * * * *